United States Patent [19]

Pavlick

[11] 4,456,413

[45] Jun. 26, 1984

[54] LOW LEVEL FREIGHT CAR FOR CARRYING TRAILERS

[75] Inventor: Michael J. Pavlick, Norristown, Pa.

[73] Assignee: The Budd Company, Troy, Mich.

[21] Appl. No.: 434,294

[22] Filed: Oct. 14, 1982

Related U.S. Application Data

[63] Continuation of Ser. No. 147,965, May 8, 1980, abandoned.

[51] Int. Cl.[3] ..... B61D 3/10; B61D 15/00

[52] U.S. Cl. ..... 410/56; 105/4 R; 213/75 R; 410/65; 410/4

[58] Field of Search ..... 105/3, 4 R; 410/2, 3, 410/4, 54, 56, 57, 65; 213/75 R

[56] References Cited

U.S. PATENT DOCUMENTS

| | | | |
|---|---|---|---|
| 2,305,444 | 12/1942 | Pond | 410/65 |
| 2,489,024 | 11/1949 | Gaynor | 410/54 |
| 2,914,003 | 11/1959 | Seel et al. | 410/54 |
| 3,357,371 | 12/1967 | Gutridge | 410/57 |
| 3,610,168 | 10/1971 | Macomber | 410/65 |
| 3,716,146 | 2/1973 | Altherr | 213/75 R |

*Primary Examiner*—Richard A. Bertsch

*Attorney, Agent, or Firm*—Edward M. Farrell; Herman Foster; Thomas I. Davenport

[57] ABSTRACT

A freight car includes main side and end frame beams. Wall structures are connected to the beams and extend downwardly therefrom. A floor structure is connected to the wall structures to provide a lower well arrangement for receiving a trailer therein.

6 Claims, 5 Drawing Figures

LOW LEVEL FREIGHT CAR FOR CARRYING TRAILERS

This is a continuation application of Ser. No. 147,965, filed May 8, 1980, now abandoned.

BACKGROUND OF THE INVENTION

So-called "piggy back" freight cars have been used to carry trailers. With the emphasis on the conservation of gasoline, carrying trailers over long distances has become increasingly more important Several problems are presented when trailers are carried by conventional freight cars. One is that the floor level of the freight car is at a set height so that the roof of the trailer being carried must also be correspondingly high. This makes it impossible for many freight cars carrying trailers to pass under many bridges and tunnels. While some attempts have been made to lower freight car floors by using smaller 28 inch wheels instead of the standard 33 inch wheel and by lowering the center plate of the trucks, these effects have generally not resulted in substantial lowering of the freight car floor.

In conventional freight cars carrying trailers, the box portion of the trailer, which may be loaded, is about seven and one-half feet above the rail. This means that the center of gravity is very high and may cause trouble during transport.

Another problem presented by many conventional freight cars is its 89 foot length. While some trailers are 40 and 42 feet in length, the recent trend has been to build trailers of 45 foot lengths. Many times, reefers extend further lengths from the front of the trailers. An 89 foot long freight car is too small to carry two trailers. Carrying a single trailer with a single 89 foot freight car is economically inefficient in many cases so as to make it unacceptable.

OBJECTS OF THE INVENTION

It is an object of this invention to provide an improved low level freight car unit capable of carrying trailers at minimum heights.

It is a further object of this invention to provide an improved low level freight car unit for carrying a single trailer of comparable length to the freight car unit.

It is still a further object of this invention to provide an improved low level freight car unit capable of being connected to an adjoining unit by a single truck supporting both ends of the adjoining car units.

It is still a further object of this invention to provide improved low level freight units having connecting trucks which make it possible to make the units relatively short.

BRIEF SUMMARY OF THE INVENTION

In accordance with the present invention, a freight car unit comparable to length to a trailer is provided to carry the trailer. Means extend downwardly from the main frame structure of the car unit with a lower floor section providing a well to receive the trailer. At least one end of the freight car unit is adapted to be supported by and coupled to a truck which also couples and supports a next adjacent car in a train.

Other objects and advantages of the present invention will be apparent and suggest themselves to those skilled in the art, from a reading of the following specification and claims taken in conjunction with the accompanying drawings.

DETAILED DESCRIPTION OF THE PREFERRED EMBODIMENTS

Figure 1:
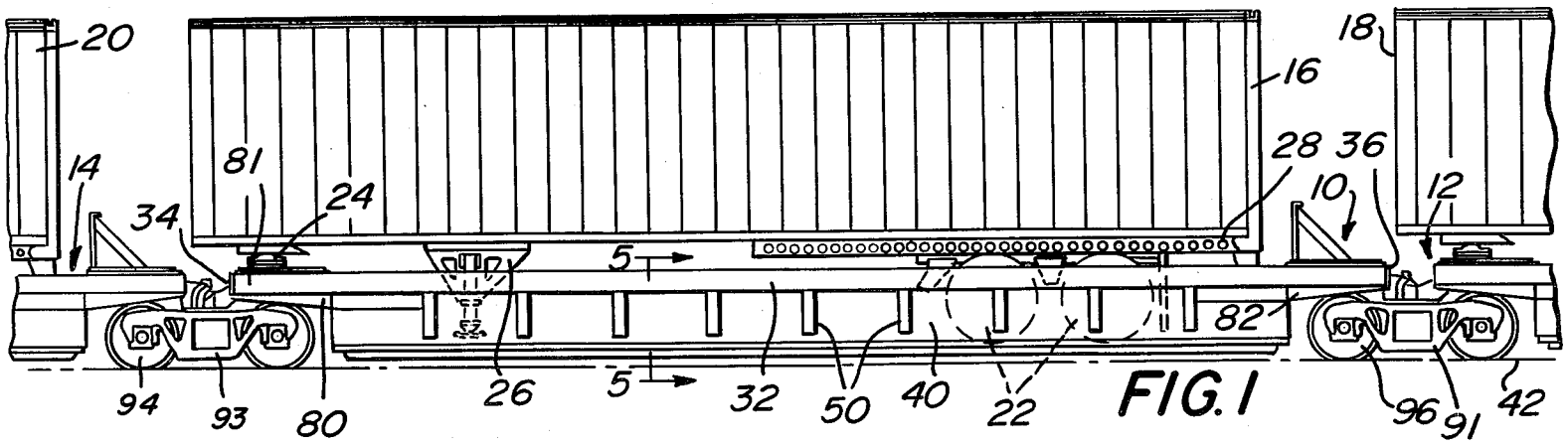
FIG. 1 is a side view illustrating a freight car unit carrying a trailer attached to adjacent freight car units carrying trailers, in accordance with the present invention.

Referring to FIGS. 1, 2, 3 and 4 of the drawings, freight car units 10, 12 and 14 are illustrated carrying trailers 16, 18 and 20, respectively. Each of the freight car units 10, 12 and 14 are basically the same and therefore only the freight car unit 10 will be described in detail.

The trailer 16 includes conventional wheels 22, a trailer hitch mechanism 24 and a landing gear 26. The trailer may include various other conventional items such as positioning rails 28, brakes and other elements not shown or illustrated.

The car unit 10 includes a pair of side tubings 30 and 32 extending longitudinally along the car. The side tubings 30 and 32, along with end channel members 34 and 36, comprise the main load bearing frame for the freight car unit 10. Side skins or walls 38 and 40 are connected to the inner surfaces of the side tubings 30 and 32 and extend downwardly toward the track 42 forming stress panels. A plurality of side brace members 48 and 50 are connected between the tubular members 30 and 32 and wall members 38 and 40, respectively. The side brace members 48 and 50 are spaced along the length of the car and are spaced at predetermined distances for reforcing wall members 38 and 40. They are tapered as they extend downwardly so as to permit maximum clearance at the bottom of the car.

Figure 5:
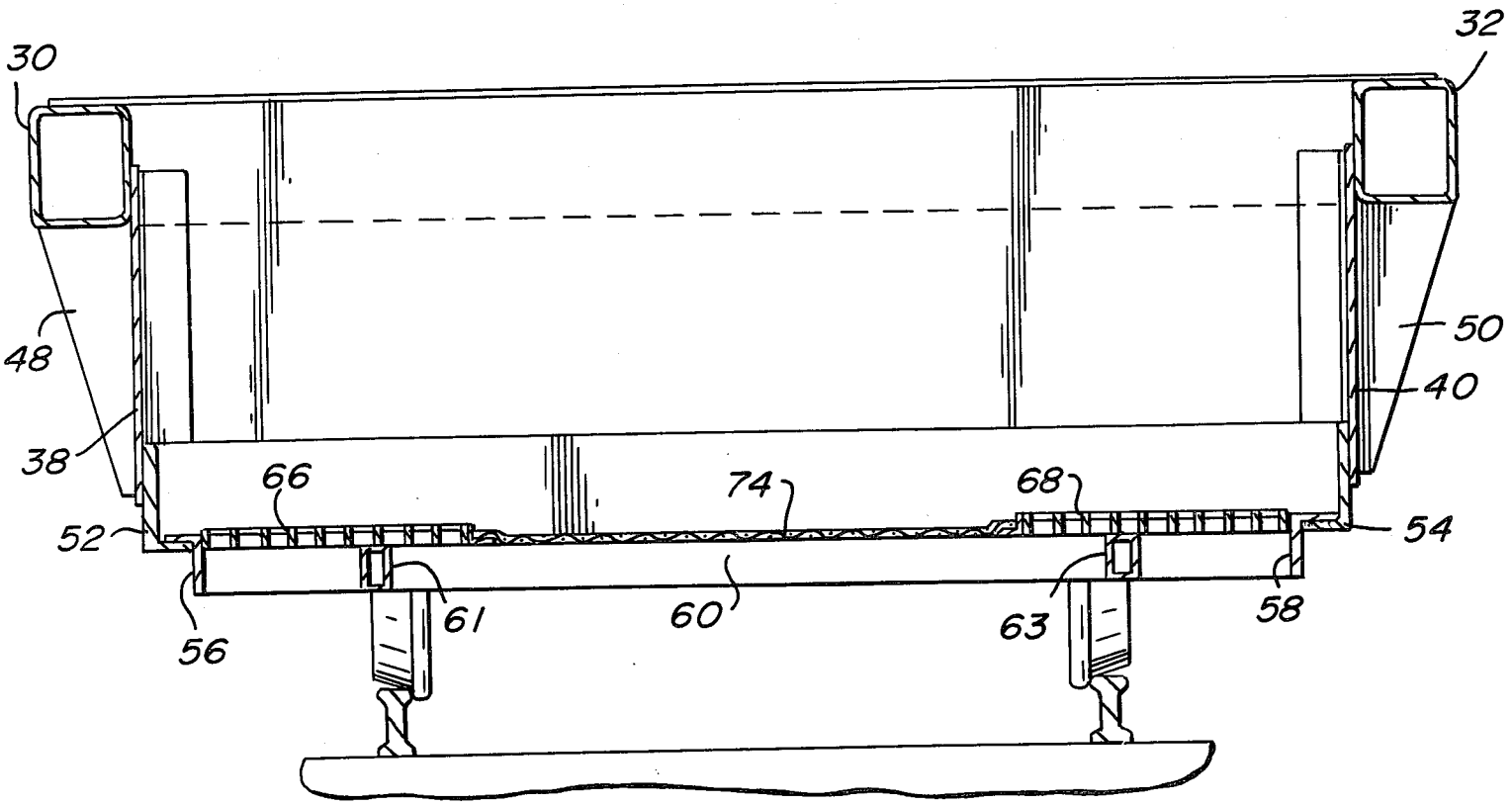
FIG. 5 is a cross-sectional view taken along lines 5—5 of FIG. 1.

As illustrated in FIG. 5, the downwardly extending walls or skins 38 and 40 are part of a well structure for receiving the trailer 16. As illustrated in FIG. 5, side angles 52 and 54 extend longitudinally along the length of the car and are welded or otherwise secured to the walls 38 and 40, respectively. Suitably welded to the side angles 52 and 54 are a pair of angular members 56 and 58, respectively. The support for the floor structure includes a plurality of cross beams 60 secured to the lower portions of the angle members 56 and 58. Tubing members 61 and 63 extend longitudinal along the floor of the car. The floor structure therefore includes a plurality of spaced cross beams extending longitudinally and laterally which are secured to walls 38 and 40. The tubular members 60, 61 and 63, along with the various members including the wall or skin members 38 and 40 provide a well area for receiving the lower portion or wheels of the trailer 16 and the members 38 and 40 transfer the load of the trailer to the side tubings 30 and 32. The tubular members may be welded together at the areas where they cross.

Figure 2:
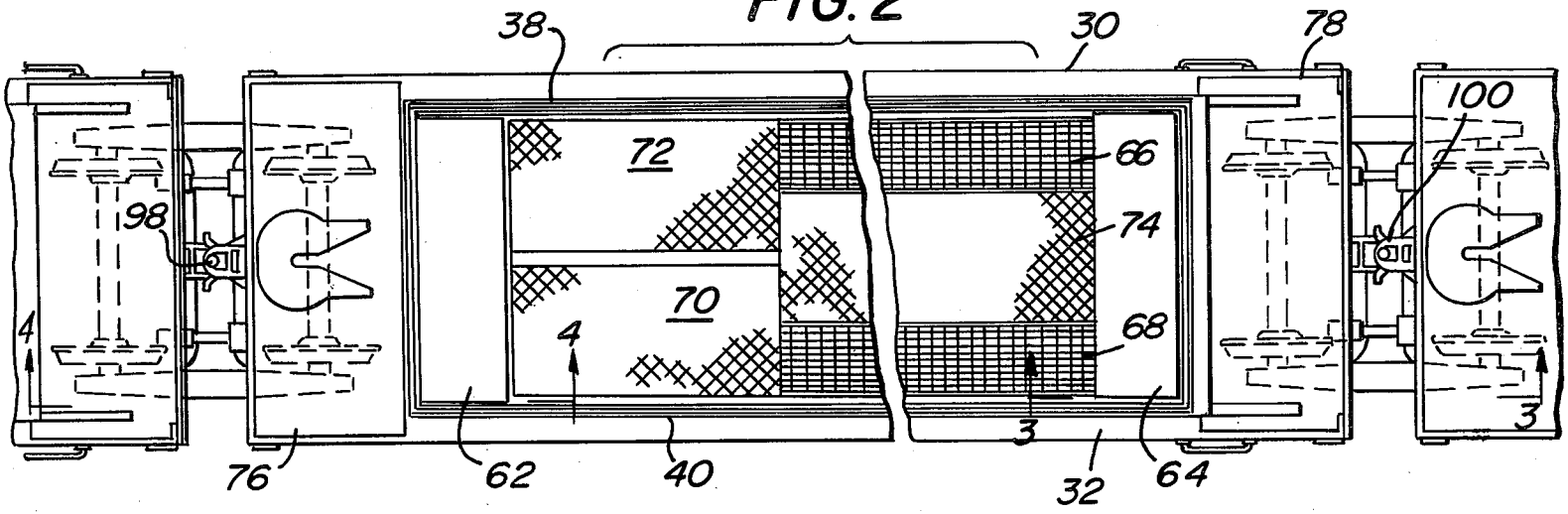
FIG. 2 is a top view, partly broken away, illustrating the freight car units of FIG. 1 without the trailers.
Figure 3:
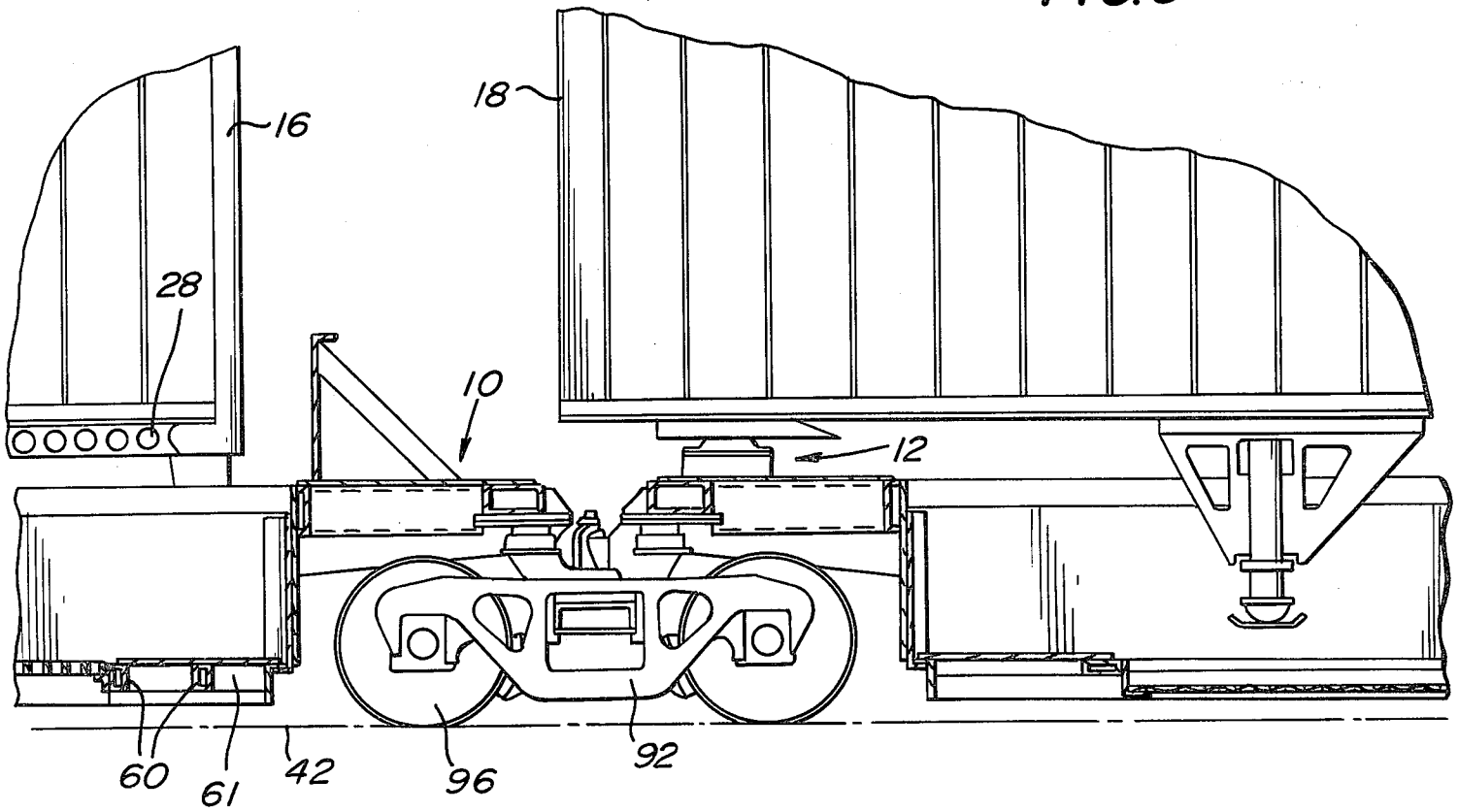
FIG. 3 is a cross-sectional view taken along lines 3—3 of FIG. 2. with the trailers illustrated in FIG. 1.

As illustrated in FIG. 2, deck plates 62 and 64 are provided on opposite ends of the freight car unit 10. A pair of heavy duty grating assemblies 66 and 68 comprise part of the floor structure and are supported by tubular members 60, 61 and 63 (FIG. 5). The heavy duty grating is used to receive the wheels 22 of the trailer 16. Expanded metal grating assemblies 70, 72 and 74 are disposed on the main floor frame structure with the metal grating 74 being disposed between the heavy duty grating 66 and 68.

Figure 4:
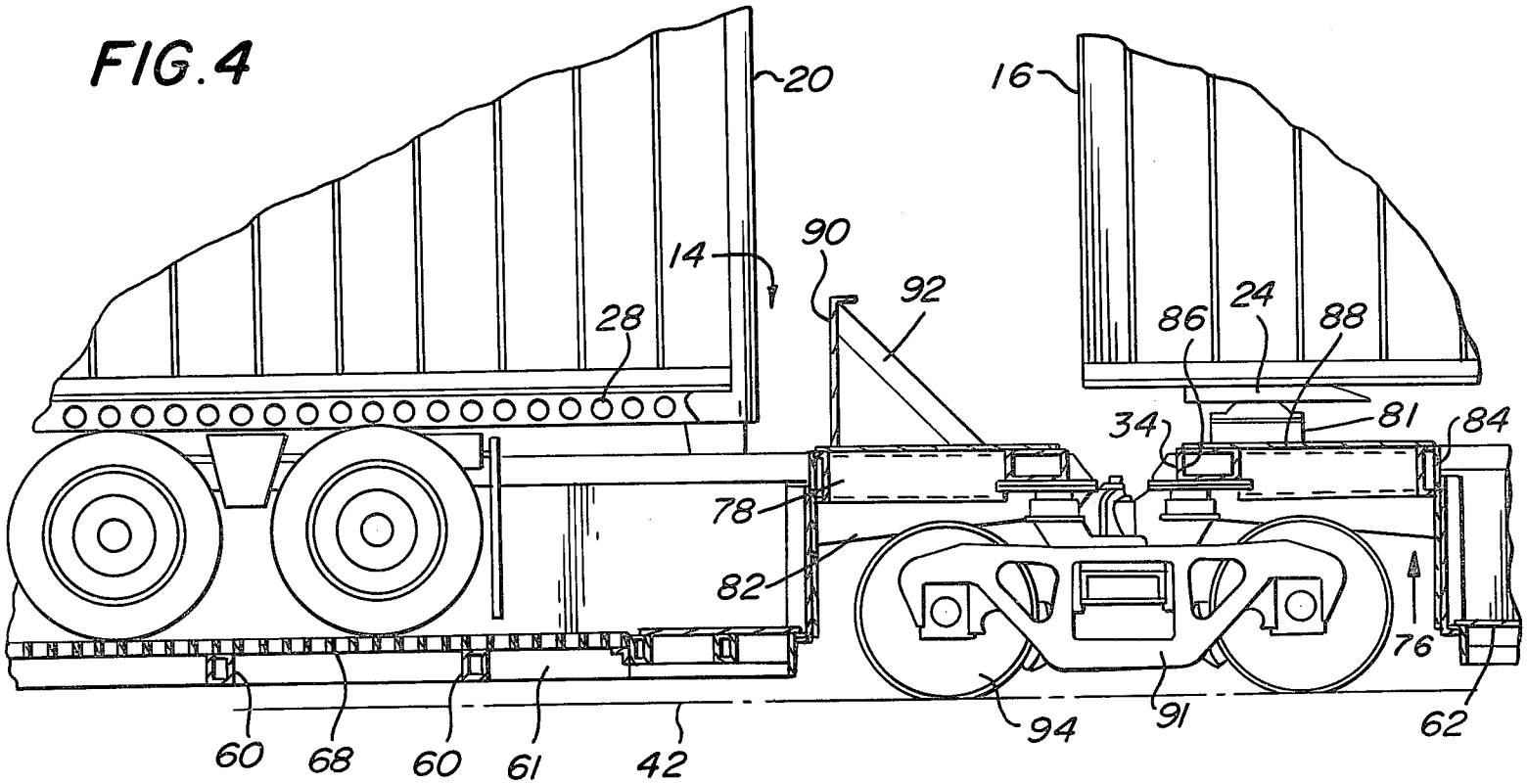
FIG. 4 is a cross-sectional view taken along lines 4—4 of FIG. 2, with the trailers illustrated in FIG. 1.

End frame assemblies 76 and 78 are provided on either side of the deck plates 62 and 64 toward the end of the car. The end frame structures 76 and 78 are reenforced and adapted to receive the coupling elements for connecting to the trucks 91, 93. The end frame structures include end channelmembers 80 and 82 (FIG. 1) and other reenforcing structures added for increased strength at the ends of the freight car unit 10. As illustrated in FIG. 4, the end frame assembly 76 includes support member 81 adapted to receive and secure the trailer hitch mechanism 24 thereon. When the trailer 16 is carried by the freight car unit 10, the wheels of the trailer 22 rest upon the grating assemblies 66 and 68 at one end and the trailer hitch 24 rests on the support member 81 at the other end. The landing gear 26 is positioned slightly above the floor level and is free of any support.

As illustrated in FIG. 4, the end frame 76 includes various structural frame members including an end channel 84, an end tube 86 and an end deck plate 88. The end deck plate 88 is disposed to rest on the end channel 84 and the end tube 86. The top plate 78 includes bracing members 90 and 92 for added strength for the end assemblies as illustrated in the trailer 20 in FIG. 4.

The total length of the freight car unit 10 is made approximately 50 feet long. The unit is designed to receive trailers as short as twenty three and one-half feet and extending through 45 feet or longer. The trailer may include various front reefers which normally would take a longer distance.

The freight car unit 10 is specifically designed to carry a single typical conventional trailer 16. In freight car units used heretofore, the length of the cars was approximately 89 feet long. Consequently, it was impossible to carry two trailers of 45 feet length necessitating the carrying of a single trailer on a single car. This made the use of the freight car for carrying a single trailer very inefficient and generally unacceptable.

The trailer is placed in the freight car unit by various conventional means including cranes and the like which lift the trailer over the freight car and lowered into position. These means are not related to the present invention and therefore not described in detail.

In order to accommodate the wheels 22 and the landing gear 26 as well as various other parts located beneath the main trailer, it is necessary that the well area provided by the floor and side and end walls be relatively free of any other mechanism. For example, using conventional truck arrangements to support the freight car at areas between the ends of the trailer would cause the trucks to project upwardly toward the trailer thereby using the required space necessary to accommodate the trailer.

Placing the supporting trucks at the end of the trailers and especially using a single truck to support the ends of two adjacent freight car units makes it possible to provide a maximum amount of space in the well area for receiving the trailer therein.

Truck assemblies 91 and 93 are disposed on either end of the freight car unit 10. The truck assemblies 91 and 93 include the elements found in many conventional trucks including the wheels 94 and 96 with their associated axle and brake assemblies. The details of the truck are not shown in detail because they may be of conventional design. The trucks 91 and 93 are adapted to receive a coupling arrangement which may be attached to two adjacent cars. The trucks 91 and 93 are adapted to receive coupling assemblies 98 and 100, respectively. The coupling assemblies include conventional male and female connector elements connected to the same central pin connection so as to permit adjacent freight car units to move about the same common central point on the trucks. A type of articulator connector adapted to be attached to the truck illustrated may be of a type manufactured by American Steel Foundries, 1005 Prudential Plaza, Chicago, Ill., 60601.

It is seen that the trailers 16, 18 and 20 are disposed at lower levels with respect to the trailers which have been carried by conventional freight cars used heretofore. The reason for this is that the floor level holding the trailers has been lowered so as to permit the trailers to become closer to the ground. In accomplishing this, as described, the trucks have been moved to the ends of the car in order to permit a maximum well area to receive the trailer. Because the trailers 16, 18 and 20 are disposed relatively low, freight cars utilizing the present invention carrying trailers are now able to pass under bridges and go through tunnels which heretofore have been impossible to pass through.

What is claimed is:

1. A low level freight car for carrying a trailer comparable in length to the length of said freight car and having trucks including wheels supporting each end of said car and at least one next adjacent freight car comprising:

(a) a main frame including a pair of load supporting longitudinal top side beams and end channels;

(b) side and end walls connected to said side beams and said end channels, respectively, extending downwardly therefrom and forming stress panels for transfering loads to said side beams and said end channels;

(c) a plurality of spaced, tapered braces extending substantially along the length of said freight car connected between said longitudinal top side beams and said side walls:

(d) a floor structure connected to the low portion of said side and end walls to provide a well area below said side beams and end channels to receive and support the bottom portion of a trailer therein and transfer the vertical load to said side and end wall stress panels, said floor structure of said well area being substantially in the same plane as the horizontal centerline of said truck wheels;

(e) said floor structure including a plurality of spaced lateral cross beams connected between the bottom portions of said downwardly extending walls having heavy grating mounted thereon for receiving the bottom portion of the trailer thereon;

(f) end frame assemblies secured to each end at said freight car adjacent said well area including coupling means secured thereto;

(g) a pair of trucks for supporting each end of said freight car; and (h) coupling means connected to said end frame assemblies being adapted to pivotally secure the respective end of said freight car on one of said trucks, and at least one of said trucks being adapted for pivotally supporting another freight car.

2. A low level freight car as set forth in claim 1 wherein said coupling means connected to said end frame assemblies are disposed to fit into a center area of said truck to join and support adjacent cars to permit said adjacent cars to be moved about said center area on said truck when said freight car is traveling around corners.

3. A low level freight car as set forth in claim 1 wherein one of said end frame assemblies includes a support member disposed to receive and secure thereto a trailer hitch mechanism.

4. A low level freight car as set forth in claim 3 wherein said floor structure further includes a pair of longitudinal angle members secured along the lower inner portions of said side walls.

5. A low level freight car as set forth in claim 4 wherein deck plates are provided at opposite ends of said freight car.

6. A low level freight car as set forth in claim 5 wherein an expanded metal member is disposed between said grating structures and form part of said floor structure.

* * * * *